US009427878B2

(12) United States Patent
Hernandez

(10) Patent No.: US 9,427,878 B2
(45) Date of Patent: Aug. 30, 2016

(54) SPRING ASSISTED KNIFE

(71) Applicant: ALLTRADE TOOLS LLC, Long Beach, CA (US)

(72) Inventor: Hector Ray Hernandez, Fullerton, CA (US)

(73) Assignee: Alltrade Tools LLC, Long Beach, CA (US)

( * ) Notice: Subject to any disclaimer, the term of this patent is extended or adjusted under 35 U.S.C. 154(b) by 89 days.

(21) Appl. No.: 14/493,146

(22) Filed: Sep. 22, 2014

(65) Prior Publication Data

US 2016/0082604 A1 Mar. 24, 2016

(51) Int. Cl.
*B26B 1/04* (2006.01)

(52) U.S. Cl.
CPC ..... *B26B 1/042* (2013.01); *B26B 1/046* (2013.01); *B26B 1/048* (2013.01)

(58) Field of Classification Search
CPC ..... B26B 1/042; B26B 1/046; B26B 1/048
See application file for complete search history.

(56) References Cited

U.S. PATENT DOCUMENTS

| | | | | |
|---|---|---|---|---|
| 725,528 | A | 4/1903 | Whiting | |
| 1,603,914 | A | 10/1926 | Hermann | |
| 3,101,998 | A | 8/1963 | Krause et al. | |
| 5,331,741 | A | 7/1994 | Taylor | |
| 5,737,841 | A | 4/1998 | McHenry et al. | |
| 5,815,927 | A | 10/1998 | Collins | |
| 6,079,106 | A * | 6/2000 | Vallotton | B26B 1/048 30/155 |
| 6,145,202 | A | 11/2000 | Onion | |
| 6,397,476 | B1 | 6/2002 | Onion | |
| 6,397,477 | B1 | 6/2002 | Collins | |
| 6,591,504 | B2 | 7/2003 | Onion | |
| 7,080,457 | B2 | 7/2006 | Sullivan | |
| 7,086,157 | B2 * | 8/2006 | Vallotton | B26B 1/046 30/159 |
| 7,246,441 | B1 | 7/2007 | Collins | |
| 7,293,360 | B2 * | 11/2007 | Steigerwalt | B26B 1/02 30/159 |
| 7,296,355 | B2 | 11/2007 | Onion | |
| 7,340,838 | B2 | 3/2008 | Onion | |
| 7,395,599 | B2 | 7/2008 | Onion | |
| 7,437,822 | B2 * | 10/2008 | Flagg | B26B 1/044 30/160 |
| 7,543,386 | B2 | 6/2009 | Sullivan | |
| 7,694,421 | B2 | 4/2010 | Lin | |
| 7,854,067 | B2 * | 12/2010 | Lake | B26B 1/044 30/159 |
| 8,001,693 | B2 | 8/2011 | Onion | |
| 8,307,555 | B2 | 11/2012 | Onion | |
| 8,893,389 | B2 * | 11/2014 | Freeman | B26B 1/046 30/155 |
| 8,966,768 | B2 * | 3/2015 | Onion | B26B 1/02 30/155 |
| 9,132,558 | B2 * | 9/2015 | Millhouse | B26B 1/048 |

* cited by examiner

*Primary Examiner* — Hwei C Payer
(74) *Attorney, Agent, or Firm* — David J. Pitman; Fulwider Patton LLP

(57) ABSTRACT

A folding knife comprising a handle which includes a left cover and a right cover that are separated from each other by a space and that are connected to each other by at least one pin; a blade configured to rotate around an axle extending between the left cover and the right cover, the blade defining a means for attachment spaced apart from the axle by an offset distance; a helical torsion spring surrounding the pin, the spring having a first end that is fixed to the handle and a second end that is free to move in relation to the handle; and a connecting element that connects the free end of the spring to the means for attachment on the blade.

13 Claims, 4 Drawing Sheets

SPRING ASSISTED KNIFE

The present application relates to folding knives. Specifically, the application relates to providing a spring to assist the blade of a folding knife to open and close.

Spring assisted folding knives are known in the art. Typically, a folding knife comprises a handle with a hollow section between two side walls of a handle. An pin, or axle, is provided at the distal end of the handle, about which a blade is configured to pivotingly rotate. The blade has a closed condition in which the blade is rotated about the pin to reside between the two side walls of the handle. In this condition the knife is safe to handle and to store. The blade has an open condition, in which the blade is rotated about the pin to extend distally away from the handle. In this condition, the knife is ready for use, which may include cutting, piercing, slicing etc. In some knives, a spring is included to provide a biasing force for urging the blade open when the blade is in a closed condition, and for urging the blade closed when the blade is not in a closed condition. In some knives, a spring may take the form of a leaf spring, in which a cantilevered tip of the leaf spring biases a cam shaped surface on the blade, thereby providing a bias to prevent the blade from opening when it is closed, and to prevent the blade from closing when it is open. In other knives, a spring may take the form of a helical spring, and may be positioned to the side of the blade within the handle of the knife. However, these knives known in the art are beset by problems. Leaf springs are limited in that they cannot be configured to bias a closed blade into an open condition. Helical springs positioned to the side of the blade within the handle are prone to collect dirt that is inaccessible to the user, and which is therefore difficult to clean out. As such, the dirt may eventually prevent the spring from operating correctly.

Thus, there is a need in the art for a folding knife with a spring that assists opening and closing of the blade, while addressing the described problems in the art. The present invention addresses these and other needs.

SUMMARY OF THE INVENTION

In a preferred embodiment, the invention is a folding knife comprising a handle which includes a left cover and a right cover that are separated from each other by a space and that are connected to each other by at least one pin. A blade is provided, configured to rotate around an axle extending between the left cover and the right cover, the blade defining a means for attachment spaced apart from the axle by an offset distance. A helical torsion spring having an elongate axis is provided. The spring surrounds the pin, the spring having a first end that is fixed to the handle and a second end that is free to move in relation to the handle. A connecting element is provided that connects the free end of the spring to the means for attachment on the blade. In some embodiments, the means for attachment is a protrusion. In some embodiments, the connecting element defines a distal slot sized to receive the protrusion, and a proximal slot sized to receive the second end of the spring. Preferably, the helical torsion spring's elongate axis and the pin are aligned parallel with the axle.

In other embodiments, the invention is a folding knife comprising a handle which includes a left cover and a right cover which are separated from each other by a space. A blade is provided, configured to rotate in a plane about an axle, the blade defining a means for attachment spaced apart from the axle by an offset distance. A helical torsion spring is provided, with an elongate axis located in the space between the left cover and the right cover, the spring being positioned with the elongate axis perpendicular to the plane, the spring having a first end that is fixed in relation to the handle and a second end that is free to move in relation to the handle. An elongate connecting element is provided that connects the free end of the spring to the means for attachment on the blade. In some embodiments, the means for attachment is a protrusion. In some embodiments, the connecting element defines a distal slot sized to receive the protrusion, and a proximal slot sized to receive the second end of the spring.

In yet other embodiments, the invention is a folding knife comprising a handle which includes a left cover and a right cover that are separated from each other by a space and that are connected to each other by at least one pin. A blade is provided, configured to rotate around an axle extending between the left cover and the right cover, the blade defining a means for attachment spaced apart from the axle by an offset distance. A spring is provided, having a first end fixed to the handle and a second end that is free to move in relation to the handle. An elongate connecting element is provided having an elongate axis, the connecting element connecting the free end of the spring to the means for attachment on the blade, wherein the elongate axis extends above a central axis of the axle when the blade is in an open condition, and wherein the elongate axis extends below the central axis of the axle when the blade is in a closed condition. In some embodiments, the spring is a torsion spring positioned with an axis that is parallel with the central axis of the axle. In some embodiments, the spring is positioned to surround one of the at least one pin. In some embodiments, the means for attachment is a protrusion from the blade. Preferably, the connecting element defines a distal slot sized to receive the protrusion, and a proximal slot sized to receive the second end of the spring.

DETAILED DESCRIPTION OF SOME OF THE EMBODIMENTS

Figure 1:
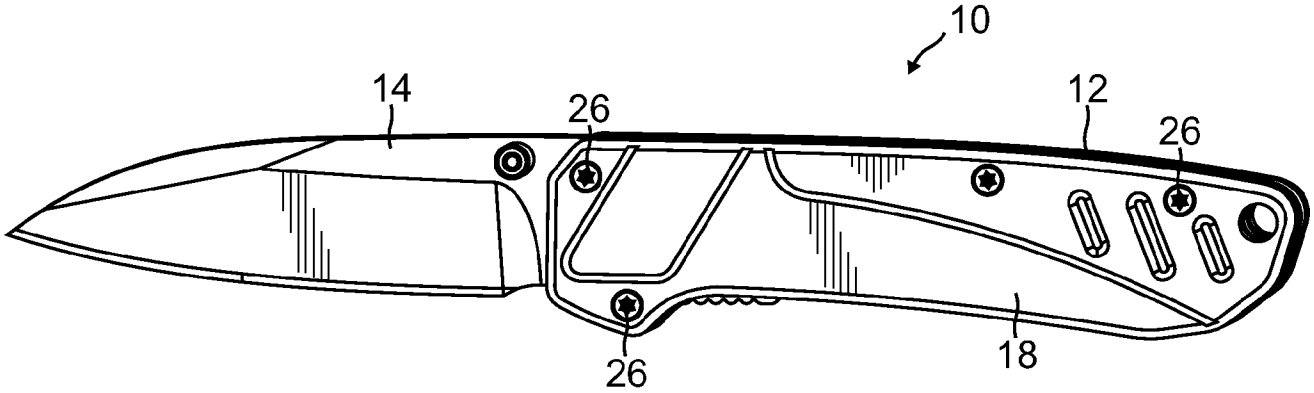
FIG. 1 is a side elevational view of a folding knife having features of the invention, shown in an open condition.

With reference to the figures, a spring assisted knife is described having features of the invention. An embodiment of the invention is shown in FIG. 1, which discloses a folding knife 10 having a handle 12 and a blade 14. In some embodiments, the handle 12 may include a right cover 16 and a left cover 18, which are removably attached by screws 26 to the handle. In some embodiments, a right liner 20 and a left liner 22 are included in the handle, and may be made of metal or other hard compound. Between the liners is situated an elongate space 28 (FIG. 3) which is sized to receive the blade 14 when the blade is in a closed condition.

The blade 14 is configured to pivot about an axle 24 that is captured by opposing liners 20, 22 in the handle. The blade may rotate between an open condition (shown in FIGS. 1-2) in which the blade extends distally for use, and a closed condition (shown in FIG. 7), in which the blade 14 resides in the space 28 for storage and safety. The end of the blade that surrounds the axle 24 includes a tang 38, which is effectively a continuation of the blade around the perimeter of a hole cut in the blade to receive the axle 24. Onto the tang 38, a protrusion 40 is attached. In some embodiments, the protrusion is attached in the form of a squeeze rivet. It will be appreciated that the protrusion 40 is offset from the center of the axle 24 by an offset distance "L" as identified in FIG. 4.

Figure 6:
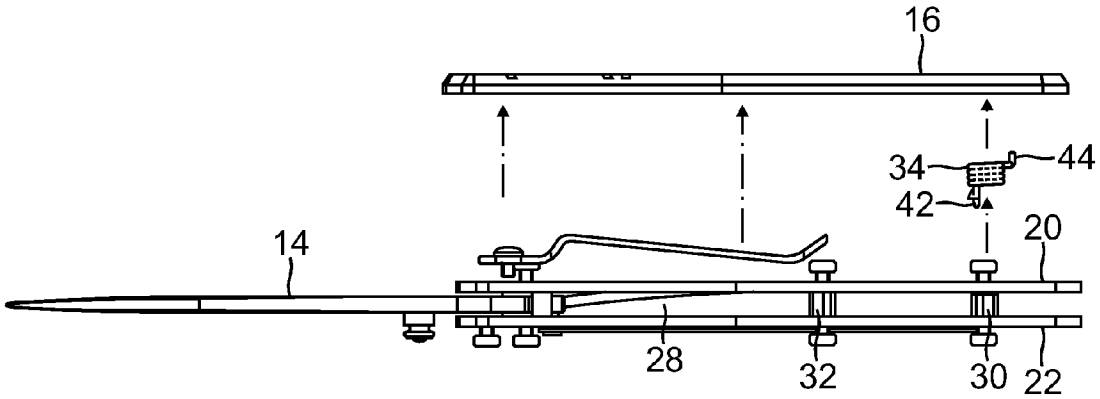
FIG. 6 is a view of the folding knife seen in FIG. 2, in partially exploded configuration to show features of the invention.

The two liners 20, 22 may be held in alignment with each other by a first pin 30 and a second pin 32 (FIG. 6), and additional pins if needed. The liner may be made of metal or other suitable hard material. The pins may be tightened in position by the screws 26.

Figure 3:
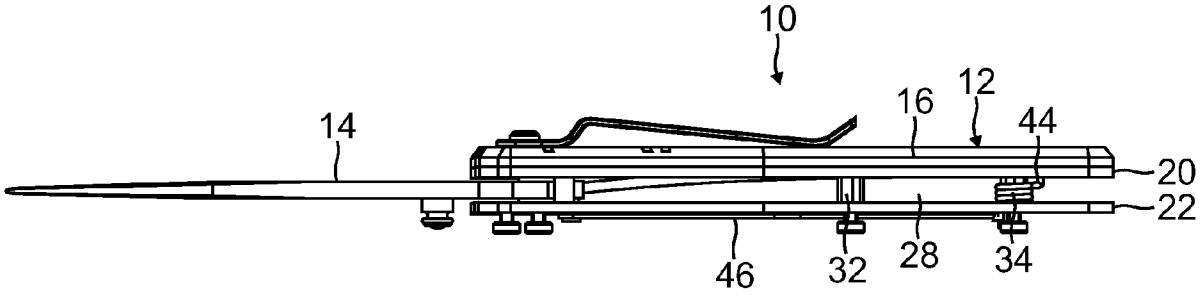
FIG. 3 is a top view of the folding knife seen in FIG. 2, with a front side cover removed to show features of the invention.

A helical torsion spring 34 is positioned to enclose the first pin 30, as may best be seen in FIG. 3. The helical spring has an elongate free end 42 which extends downwardly. The spring also has a fixed end 44 which is held stationary by being inserted into a small hole in the right liner 20. In this position, the spring is easily accessible to the user, who may consequently ensure that no dirt or grit is entering the spring and interfering with its operation.

The left liner 22 may be configured to define an elongate opening 36. A small channel 50 (seen in FIG. 8) may be cut or otherwise formed in the left cover 18 that follows the same perimeter as the opening 36.

Figure 2:
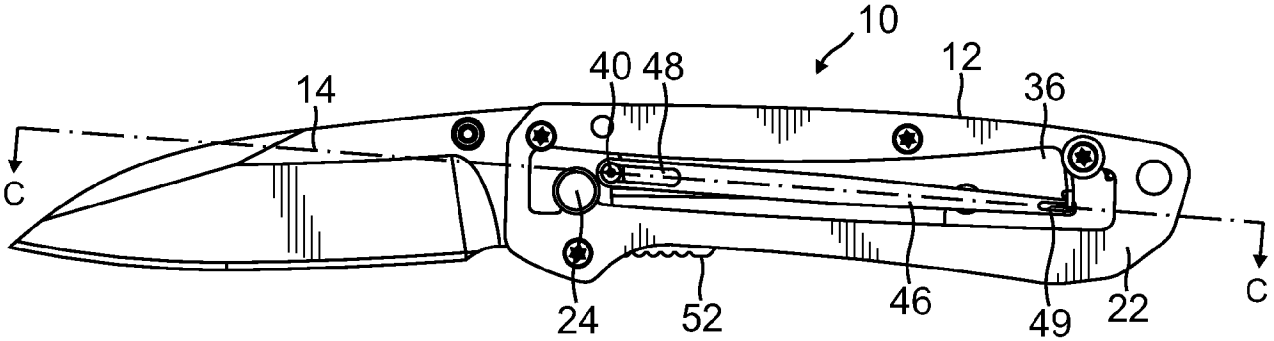
FIG. 2 is a side elevational view of the folding knife shown in FIG. 1, with a front side cover removed to show features of the invention, and shown in an open condition.
Figure 5:
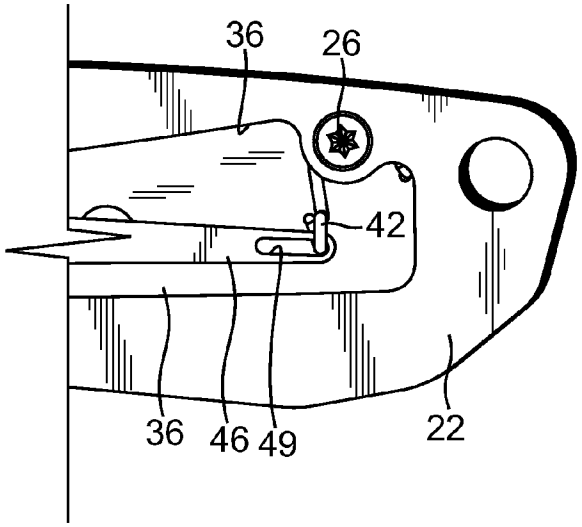
FIG. 5 is a side elevational view showing a detail of FIG. 2.
Figure 4:
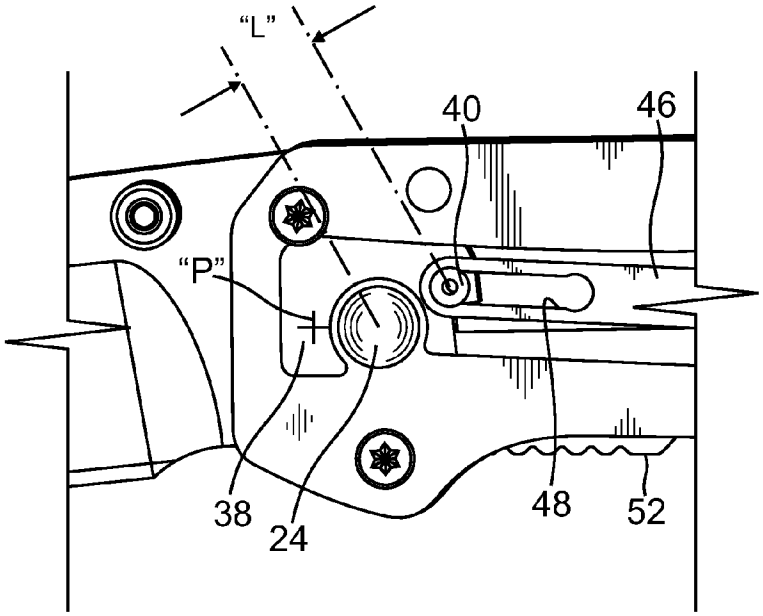
FIG. 4 is a side elevational view showing a detail of FIG. 2.

Turning to FIG. 2, an elongate connector element 46 is provided. The connector element defines an elongate distal slot 48, and an elongate proximal slot 49. The distal slot 48 is configured to receive the protrusion 40 on the tang 38 (detail view in FIG. 4) and the proximal slot 49 is configured to receive the free end 42 of the spring 34 (detail view in FIG. 5). Thus, the connector element connects the blade 14 with the spring 34. In the open condition, as seen in FIGS. 2, 4, and 5, the free end 42 of the spring urges the connector element 46 proximally, and hence urges the protrusion 40 proximally. This bias tends to urge the blade to the open condition. (However, the blade may be held in a locked open condition by a liner lock 52 of a kind that is known in the art.)

It will be appreciated by those of ordinary skill in the art that, as the blade 14 rotates about the axle 24, the protrusion 40 rotates about the axle 24 with enhanced offset "L" as identified in FIG. 4. Thus, if the blade is moved from the open condition towards a closed condition (FIG. 7), the protrusion 40 will initially move in a substantially distal direction, away from the spring 34. It will be appreciated that, consequently, the spring will tend to resist the rotation of the blade from an open towards a closed condition during the initial closing movement of the blade. However, once the blade has rotated beyond a critical point (shown as point "P" in FIG. 4), it will not be necessary to apply a manual force to rotate the blade towards the closed condition by hand, and the spring will take over and will on its own cause the protrusion to move proximally by a small amount, and hence will cause the blade to move towards the final closed position (FIG. 7) without manual assistance. Conversely, once the blade is closed (FIG. 7), a user may apply a manual force to rotate the blade towards the open position. It will be appreciated with reference to FIG. 7 that the user need only rotate the blade by a few degrees against the bias applied by the torsion spring towards the open position (FIG. 2), before the protrusion reaches the critical point "P", whereupon the force applied by the spring will tend to snap the blade to the open condition without any further force applied by hand. The critical point, as indicated as point "P" on FIG. 4, is in effect a point which lies on an intersection between the circumference of the axle 24 and a line extending from the second end 42 of the spring through the centerline B-B (see FIG. 8) of the axle.

Figure 7:
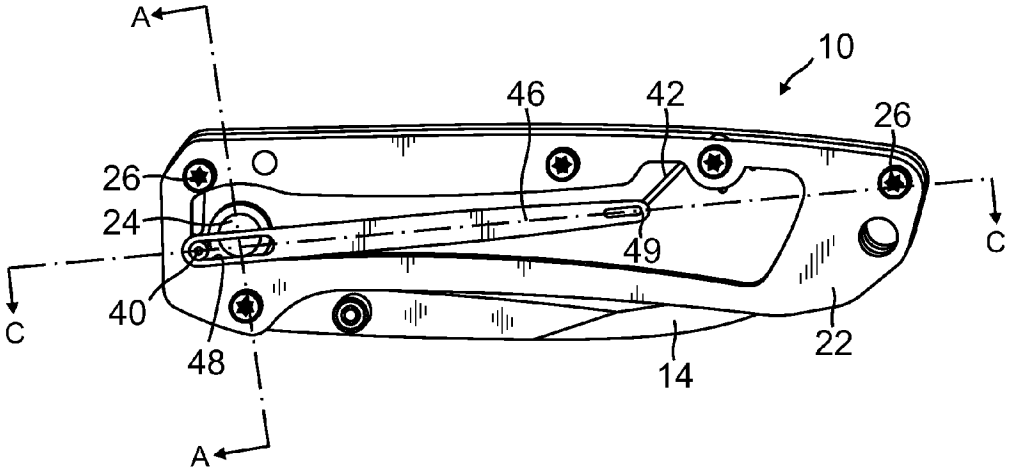
FIG. 7 is a side elevational view of the folding knife of FIG. 2, shown in a closed condition.
Figure 8:
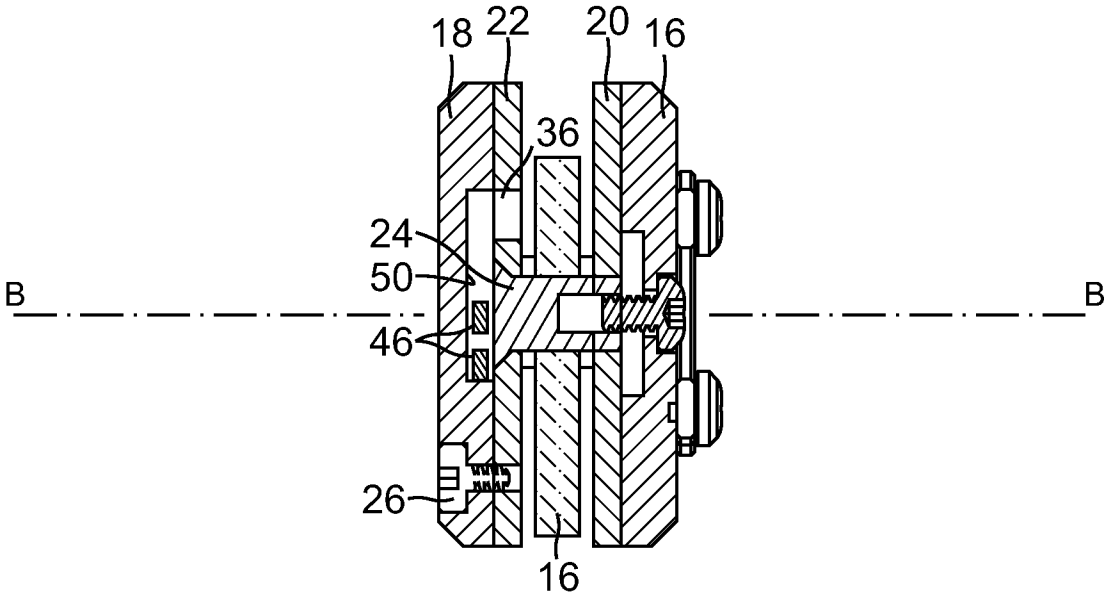
FIG. 8 is a sectional view of the folding knife in the condition shown in FIG. 7, taken substantially along the line A-A in FIG. 7.

In order for the blade 14, in combination with the protrusion 40 and the connector element 46, to move beyond the critical point described above, the connector element 46 must be able to slide alongside and past the axle 24, as shown by comparing FIG. 2 with FIG. 7—and as also shown in FIG. 8, which is a sectional view taken through FIG. 7. Specifically, with reference to FIG. 2 showing the blade in an open condition, it may be seen that the elongate axis C-C of the connector element 46 is positioned so that when extended, it lies above the central axis of the axle 24 of the knife; whereas, with reference to FIG. 7 showing the blade in a closed condition, it may be seen that the elongate axis C-C of the connector element 46 is positioned so that it lies below the central axis of the axle 24 of the knife.

Stated another way, the connector element 46 must be configured in relation to the other elements of the knife so that the connector element 46 is movable to cross over the center line B-B of the axle 24 when it moves from an open condition to a closed condition. This feature provides the knife with the advantage of a system in which the connector element 46 urges the blade towards a closed condition when the blade is closed, and towards an open condition when the blade is open.

Thus, the present invention discloses new and useful features of a spring assisted knife that overcome problems in the prior art.

Although preferred illustrative variations of the present invention are described above, it will be apparent to those skilled in the art that various changes and modifications may be made thereto without departing from the invention. It is intended in the appended claims to cover all such changes and modifications that fall within the true spirit and scope of the invention.

I claim:

1. A folding knife comprising:

a handle which includes a left cover and a right cover that are separated from each other by a space and that are connected to each other by at least one pin;

a blade configured to rotate around an axle extending between the left cover and the right cover, the blade defining a means for attachment spaced apart from the axle by an offset distance;

a helical torsion spring having an elongate axis and surrounding the pin, the spring having a first end that is fixed to the handle and a second end that is free to move in relation to the handle; and a connecting element that connects the free end of the spring to the means for attachment on the blade; and further wherein the helical torsion spring's elongate axis and the pin are aligned and parallel with the axle.

2. The folding knife of claim 1, wherein the means for attachment is a protrusion.

3. The folding knife of claim 2, wherein the connecting element defines a distal slot sized to receive the protrusion.

4. The folding knife of claim 1, wherein the connecting element defines a proximal slot sized to receive the second end of the spring.

5. A folding knife comprising:

a handle which includes a left cover and a right cover which are separated from each other by a space;

a blade configured to rotate in a plane about an axle, the blade defining a means for attachment spaced apart from the axle by an offset distance;

a helical torsion spring with an elongate axis located in the space between the left cover and the right cover, the spring being positioned with the elongate axis perpendicular to the plane, the spring having a first end that is fixed in relation to the handle and a second end that is free to move in relation to the handle; and an elongate connecting element that connects the free end of the spring to the means for attachment on the blade.

6. The folding knife of claim 5, wherein the means for attachment is a protrusion.

7. The folding knife of claim 6, wherein the connecting element defines a distal slot sized to receive the protrusion.

8. The folding knife of claim 5, wherein the connecting element defines a proximal slot sized to receive the second end of the spring.

9. A folding knife comprising:

a handle which includes a left cover and a right cover that are separated from each other by a space and that are connected to each other by at least one pin;

a blade configured to rotate around an axle extending between the left cover and the right cover, the blade defining a means for attachment spaced apart from the axle by an offset distance;

a spring having a first end fixed to the handle and a second end that is free to move in relation to the handle; and an elongate connecting element having an elongate axis, the connecting element connecting the free end of the spring to the means for attachment on the blade, wherein the elongate axis extends above a central axis of the axle when the blade is in an open condition, and wherein the elongate axis extends below the central axis of the axle when the blade is in a closed condition; and further wherein the spring is a torsion spring positioned with an axis that is parallel with the central axis of the axle.

10. The folding knife of claim 9, wherein the spring is positioned to surround one of the at least one pin.

11. The folding knife of claim 9, wherein the means for attachment is a protrusion.

12. The folding knife of claim 11, wherein the connecting element defines a distal slot sized to receive the protrusion.

13. The folding knife of claim 9, wherein the connecting element defines a proximal slot sized to receive the second end of the spring.

* * * * *